US012376652B2

(12) United States Patent
Bock

(10) Patent No.: US 12,376,652 B2
(45) Date of Patent: Aug. 5, 2025

(54) SYSTEMS AND METHODS FOR FASTENING A SHOE

(71) Applicant: PUMA SE, Herzogenaurach (DE)

(72) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 16 days.

(21) Appl. No.: 18/376,347

(22) Filed: Oct. 3, 2023

(65) Prior Publication Data

US 2024/0057722 A1 Feb. 22, 2024

Related U.S. Application Data

(62) Division of application No. 16/462,039, filed as application No. PCT/EP2016/001968 on Nov. 22, 2016, now Pat. No. 11,805,854.

(51) Int. Cl.

| | |
|---|---|
| ***A43C 11/00*** | (2006.01) |
| ***A43B 3/36*** | (2022.01) |
| ***A43B 3/44*** | (2022.01) |
| ***A43B 11/00*** | (2006.01) |
| ***A43C 7/08*** | (2006.01) |
| ***A43C 11/16*** | (2006.01) |

(52) U.S. Cl.

CPC ..... *A43C 11/165* (2013.01); *A43B 3/36* (2022.01); *A43B 3/44* (2022.01); *A43B 11/00* (2013.01); *A43C 7/08* (2013.01); *A43C 11/008* (2013.01)

(58) Field of Classification Search

CPC .. A43B 3/36; A43B 3/44; A43B 11/00; A43C 7/08; A43C 11/008; A43C 11/165

See application file for complete search history.

(56) References Cited

U.S. PATENT DOCUMENTS

| | | | | |
|---|---|---|---|---|
| 7,752,774 | B2 * | 7/2010 | Ussher | A43B 11/00 36/138 |
| 9,204,690 | B1 * | 12/2015 | Alt | A43C 11/165 |
| 9,848,674 | B2 * | 12/2017 | Smith | A43C 11/00 |
| 2009/0272013 | A1 * | 11/2009 | Beers | A43B 3/0078 36/137 |
| 2013/0104429 | A1 * | 5/2013 | Torres | A43C 1/003 36/136 |
| 2014/0070042 | A1 * | 3/2014 | Beers | A43B 3/34 242/413 |
| 2014/0292396 | A1 * | 10/2014 | Bruwer | H03K 17/962 327/517 |
| 2015/0250268 | A1 * | 9/2015 | Alt | A43C 11/165 24/68 SK |
| 2016/0345681 | A1 * | 12/2016 | Pheil | A43B 3/34 |
| 2018/0125168 | A1 * | 5/2018 | Beers | A43B 3/40 |

* cited by examiner

*Primary Examiner* — Sharon M Prange
(74) *Attorney, Agent, or Firm* — Quarles & Brady LLP

(57) ABSTRACT

A method for fastening a shoe is disclosed. The shoe has an upper part connected to a sole and a rotary closure that fastens the shoe using at least one tensioning element. The rotary closure has a rotatably arranged tensioning roller, and the tensioning roller is driven by an electric motor and a switching element. The switching element is connected to a controller, and includes touch sensitive sensors which form a surface that is accessible to the wearer. The switching element and the controller are configured to actuate the motor, and operation of fastening the shoe takes place by the controller detecting a first swipe signal over the touch sensitive sensors, and causing the fastening of the shoe at a first level of fastening force by the controller and the electric motor.

18 Claims, 2 Drawing Sheets

SYSTEMS AND METHODS FOR FASTENING A SHOE

CROSS REFERENCE TO RELATED APPLICATIONS

Figure 1:
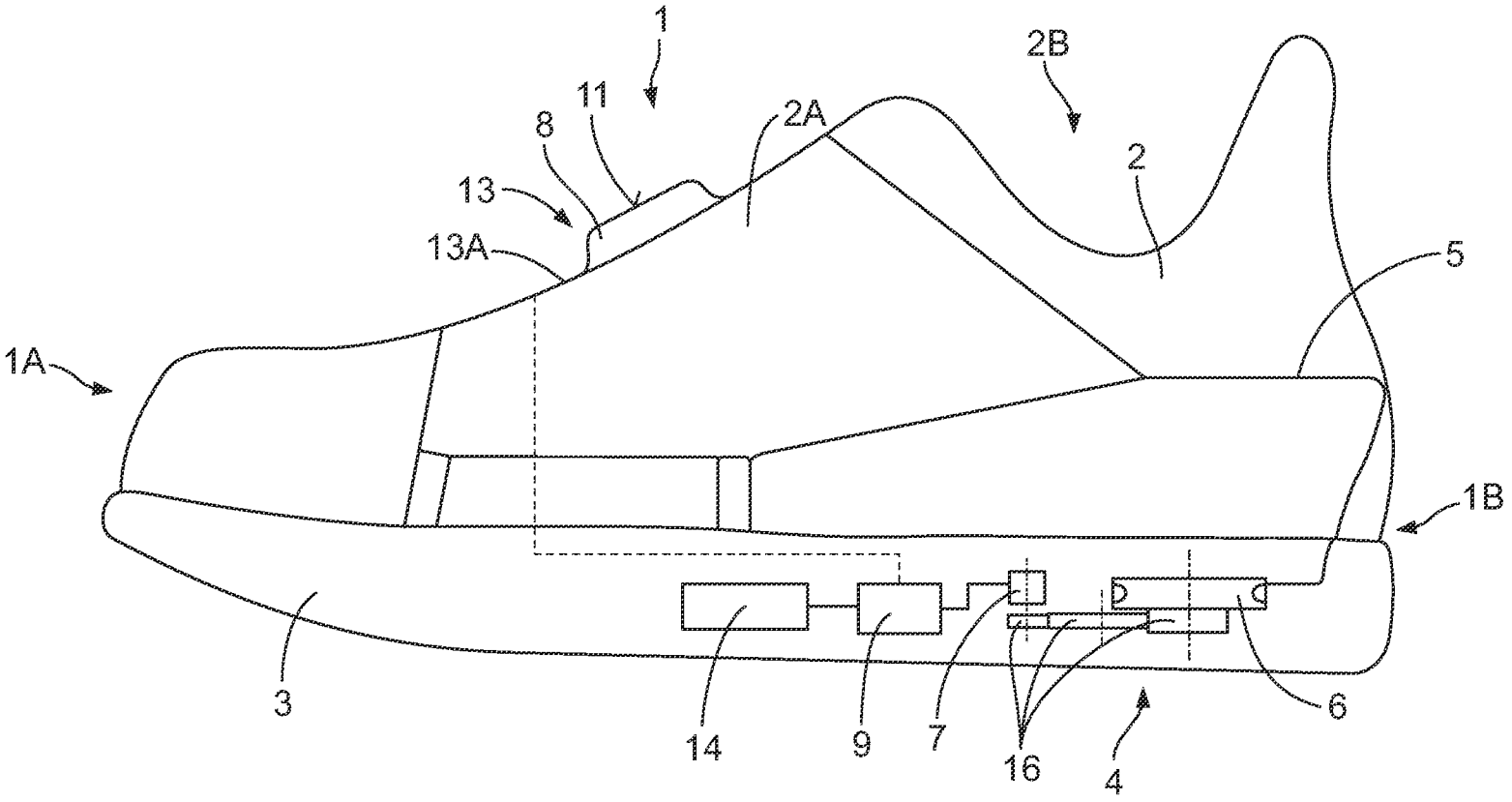

This application is a divisional of U.S. patent application Ser. No. 16/462,039, filed on May 17, 2019, which is a U.S. National Stage application, filed pursuant to 35 U.S.C. § 371, of international patent application no. PCT/EP2016/001968, filed on Nov. 22, 2016, which are each incorporated by reference herein in their entirety.

The invention relates to a method for fastening a shoe, in particular a sports shoe, wherein the shoe comprises:

- an upper part and a sole which is connected with the upper part,
- a rotary closure for fastening the shoe on the wearer's foot by means of at least one tensioning element, wherein the rotary closure comprises a rotatably arranged tensioning roller for winding the tensioning element, wherein the tensioning roller being driven by means of an electric motor,
- a switching element which is connected to control means, wherein the switching element and the control means can actuate the electric motor,
- wherein the operation of fastening the shoe takes place by actuating of the switching element by the user of the shoe, preferably using a finger.

Furthermore, the invention relates to a shoe, in particular to a sports shoe.

A shoe with an electric motor driven rotary closure is known from DE 298 17 003 U1. Here, a tension roller for winding up a tension element is driven by an electric motor so that the shoe can be laced and unlaced automatically.

To tie the shoe, the user operates an electric switch and activates the electric motor of the rotary closure as long as the switch is pressed. The lacing force gradually increases accordingly. When the desired lacing force level is reached, the user releases the switch. Another switch can be used to release the lacing force.

Therefore, the lacing of the shoe requires an appropriate time during which the user must press the switch. In addition, the user must set the desired lacing force level for each lacing.

It is the object of the invention to further develop a method of the type mentioned above in such a way that lacing the shoe can be done more comfortably and in a simplified manner. In particular, it should be possible to adapt the lacing of the shoe to individual wishes in a user-friendly way. This should make it possible to put on the shoe with a defined lacing force level according to the user's wishes without a great operating effort. Furthermore, an appropriate shoe should be made available.

The solution of the object by the invention is characterized in that the switching element comprises a number of touch-sensitive sensors which are arranged one beside the other and form a surface which is accessible to a user (especially for a finger of the user), wherein the method comprises the steps:

- Passing over the surface of the touch-sensitive sensors by the user, preferably with the finger, in a first direction,
- Detecting of the signal of the touch-sensitive sensors by the control means and causing of the fastening of the shoe at the foot of the wearer at a first level of fastening force by the control means and the electric motor.

The method can furthermore comprise the steps:

- Newly passing over the surface of the touch-sensitive sensors by the user, preferably with the finger, in the first direction,
- Detecting of the signal of the touch-sensitive sensors by the control means and causing of the fastening of the shoe at the foot of the wearer at a second level of fastening force which is higher than the first level of fastening force by the control means and the electric motor.

Thus a second, higher lacing force level can be easily reached. This principle can also be continued: The method can also include the steps:

- Newly passing over the surface of the touch-sensitive sensors by the user, preferably with the finger, in the first direction,
- Detecting of the signal of the touch-sensitive sensors by the control means and causing of the fastening of the shoe at the foot of the wearer at a third level of fastening force which is higher than the second level of fastening force by the control means and the electric motor.

Further passings of the touch-sensitive sensors can also be carried out to further increase the lacing force level step by step. A lacing force level is preferably defined by the current with which the electric motor is operated (see below).

The opening of the shoe or the reduction of the lacing force level is preferred by carrying out the following steps:

- Passing over the surface of the touch-sensitive sensors by the user, preferably with the finger, in a second direction which is opposite to the first direction,
- Detecting of the signal of the touch-sensitive sensors by the control means and causing of the opening of the shoe or of a reduction of the level of the fastening force by the control means and the electric motor.

For the fully de-laced end position, the tensioning roller can be equipped with a rotation angle sensor which is able to detect the zero position of the tensioning roller.

The above-mentioned passing of the surface of the touch-sensitive sensors is done according to a preferred procedure in such a way that the user (preferably using a finger) completely passes over the sensors, i. e. over the entire surface area of the sensors. In this way—as described—the lacing force level can be increased step by step or in steps; in the same way the lacing force level can be reduced or the shoe completely opened (if the surface is passed in the opposite direction).

However, it is also possible not to pass the surface of the touch-sensitive sensors completely, but only over a part of their extension (with the finger). Depending on the length over which the user has passed the surface, the controller can then send a (preferably proportional) signal to the electric motor so that the tension of the lacing is increased accordingly or reduced (by passing in the opposite direction).

Thus, the proposed procedure allows a stepwise closing (lacing) and opening (re-lacing) of the shoe, for which the surface of the touch-sensitive sensors is completely or only partially passed over in order to be able to finely adjust said lacing or opening.

This makes it possible, by simply passing over the number of touch-sensitive sensors (in the first direction), to approach specifically defined lacing force levels of the shoe and also to open the shoe, i. e. release the tension element, by passing over the sensors once (in the second direction).

This makes lacing and unlacing very easy and comfortable.

At or on the switching element a number of illumination elements, especially in the form of Light-Emitting Diodes (LED), can be arranged, wherein the actual level of the fastening force is displayed by the number of activated illumination elements. This allows the user of the shoe to easily see how tightly the shoe is currently laced on the foot. The more LEDs light up, the more the shoe is tightened. The open state of the shoe can also be indicated by the LEDs.

The proposed shoe with rotary closure and switching element is characterized by the invention in that the switching element is formed by a number of touch-sensitive sensors which are arranged one beside the other which form a surface which is accessible to a user (especially for a finger of the user). The common surface of the sensors is as smooth and even as possible.

This is to be understood in such a way that the individual touch-sensitive sensors can be activated by passing over the surface in order to generate the above-mentioned functionality.

The single touch-sensitive sensors are thereby designed preferably as capacitive sensors.

The single touch-sensitive sensors are arranged preferably side by side in a linear formation, wherein preferably between 3 and 7 touch-sensitive sensors are arranged side by side.

At or on the switching element a number of illumination elements, especially LEDs, are preferably arranged.

According to a preferred embodiment the switching element and the rotary closure are arranged at different locations of the shoe. The switching element is preferably arranged at the instep of the shoe; the rotary closure is preferably arranged in the sole of the shoe.

However, other positions are also possible for the switching element and the rotary closure. Both elements can be arranged as a unit on the instep. It is also possible to arrange the switching element in the side area of the shoe or the upper part of the shoe or in the heel area. Here, too, a combination with the rotary closure to form a unit (consisting of rotary closures and switching element) is possible.

As explained above, the user will usually pass over the surface of the touch-sensitive sensors with his finger. However, this is not mandatory; it can also be provided that an aid (e. g. a pen) is used for passing.

Spring means can be arranged in the upper part which bias the upper part against the force of the tensioning element in an open-position. This ensures that the upper part of the shoe "folds open" into an open position after the rotary closure has been opened, making it easier to put on and take off the shoe.

For the supply of energy preferably a rechargeable battery is arranged in the shoe which is rechargeable inductively and/or contactless. In this case, the battery required for the operation of the motor is therefore designed as a rechargeable battery and is supplied with a charging current via an induction coil. The battery can be arranged in a (mid) sole of the shoe. The electronics required for charging can be placed directly on the battery. By providing an induction coil, the shoe's battery can be charged without contact. The shoe can be placed on an appropriate charging plate to charge the battery. The LEDs mentioned above can also be used to indicate charging or the charging status. For example, the LEDs may flash during charging, with more and more LEDs flashing as the battery is charged more and more.

It can also be provided that the state of charge of the battery is indicated by the LEDs while the shoe is in use. For example, at a certain charge level (e. g. when the battery is less than 50% of its maximum charge level) the LEDs may start flashing.

The shoe can also comprise an interface which is designed for a wireless communication with a mobile phone, especially for the communication via Bluetooth. Thus, communication with the mobile phone (smartphone) can take place via a wireless connection and in this case the switching element can be moved into the mobile phone; in this case the switching element is formed by the mobile phone. This means that the rotary closure can be controlled wirelessly via Bluetooth using a smartphone, which is equipped with a corresponding app for this purpose.

The touch-sensitive sensors mentioned here are commercially available as such and are also referred to as "swipe sensor" or "touch panel". These are generally a number (usually between three and seven) of sensors arranged next to each other, each of which is touch-sensitive. This enables the controller to recognize which action (closing or opening) is to be carried out by means of the sequence of measured impulses from the individual sensors at passing in the first or second direction.

The first lacing force level is preferably defined by a first predetermined maximum current, which the controller sets for the electric motor during the lacing process; this current is preferably between 1.1 A and 1.9 A. The second lacing force level is defined analogously and preferably by a second predetermined maximum current which the control gives to the electric motor during the lacing operation, wherein the second maximum current being higher than the first maximum current; said current preferably being between 2.1 A and 2.9 A. The third level of lacing force is correspondingly preferably defined by a third predetermined maximum current which the controller gives to the electric motor during the lacing operation, wherein the third maximum current being higher than the second maximum current; the current is preferably between 3.1 A and 3.9 A.

These lacing force levels are thus defined by the specification of a corresponding motor current (e. g. first level: 1.5 A—second level: 2.5 A—third level: 3.5 A), so that the motor is operated with corresponding maximum torques, which in turn leads to a corresponding increasing tensile force in the tensioning element via the preferred gear between motor and tensioning roller.

Preferably a first tensioning element is arranged which runs on the lateral side of the upper part of the shoe, wherein a second tensioning element being arranged which runs on the medial side of the upper part of the shoe; both tensioning elements are fastened with their two ends to the tensioning roller and form a closed curve on the lateral side and on the medial side of the upper part of the shoe respectively.

The two curves of the two tensioning elements on the lateral side and on the medial side of the upper are preferably substantially symmetrical to a central plane of the shoe, with the central plane running vertically and in the longitudinal direction of the shoe.

A special guidance of the two tensioning elements on both sides of the shoe upper is particularly preferred in order to achieve an optimal distribution of the tensile force and thus an optimal contact of the shoe with the wearer's foot.

After this, each tensioning element can run from the tensioning roller to a first deflecting element which deflects the tensioning element in the lower part of the upper part of the shoe and at a point which lies in the range between 30% and 42% of the longitudinal extension of the shoe, calculated from the tip of the shoe.

Furthermore, each tensioning element may be provided to extend from the first deflecting element to a second deflecting element which deflects the tensioning element in the lower region of the upper part of the shoe and at a point which lies in the range between 50% and 60% of the longitudinal extent of the shoe, calculated from the tip of the shoe.

Furthermore, each tensioning element can run from the second deflecting element to a third deflecting element, wherein the tensioning element being located in the upper region of the upper part of the shoe adjacent to the rotary closure.

Each tension member may also extend from the third deflecting element to a fourth deflecting element which deflects the tensioning element in the lower portion of the uppers and at a location in the range between 55% and 70% of the length of the shoe, calculated from the tip of the shoe.

Finally, each tensioning element may be provided to extend from the fourth deflecting element to a fifth deflecting element which deflects the tensioning element in the range between 33% and 66% of the total height of the shoe and at a location which is in the range between 75% and 90% of the longitudinal extent of the shoe, calculated from the tip of the shoe, wherein the tensioning element extending from the fifth deflecting element to the tensioning roller.

The abovementioned positioning of the deflection elements in the lower region of the upper part of the shoe is to be understood in such a way that the deflection elements are fixed to the sole of the shoe or to the upper part of the shoe slightly above the sole and thus the deflection point of the tensioning element lies in a height range which lies below a mark of 20% of the vertical extent (when the shoe stands on the ground) of the upper part of the shoe.

At least one of the deflection elements can be designed as a loop which is attached to the upper part of the shoe and/or to the sole of the shoe, in particular sewn on.

The loops may consist of a band sewn to the upper part and/or sole of the shoe.

The fifth deflection element mentioned above preferably encompasses the heel area of the shoe. It is preferably intended that the fifth deflection element has a V-shaped configuration in the side view of the shoe, one leg of the V-shaped structure ending in the upper heel area and the other leg of the V-shaped structure ending in the lower heel area in the side view of the shoe.

The tensioning elements are preferably tensioning wires. They can comprise polyamide or can be made of this material.

In an advantageous way, the ease of use can be improved when using a shoe with an electromotive lacing system with a rotary closure.

The proposed method may also be further developed by placing a pressure sensor on or inside the shoe to detect the degree of lacing tension of the shoe on the wearer's foot. This pressure can be compared with a value stored in the controller. If a too high pressure is detected while wearing the shoe, it can be provided that the control automatically causes a reduction of the lacing tension. Conversely, if the pressure is too low, the shoe can also be laced again, which can be done by the control system self-sufficiently.

In the drawings an embodiment of the invention is shown.

Figure 2:
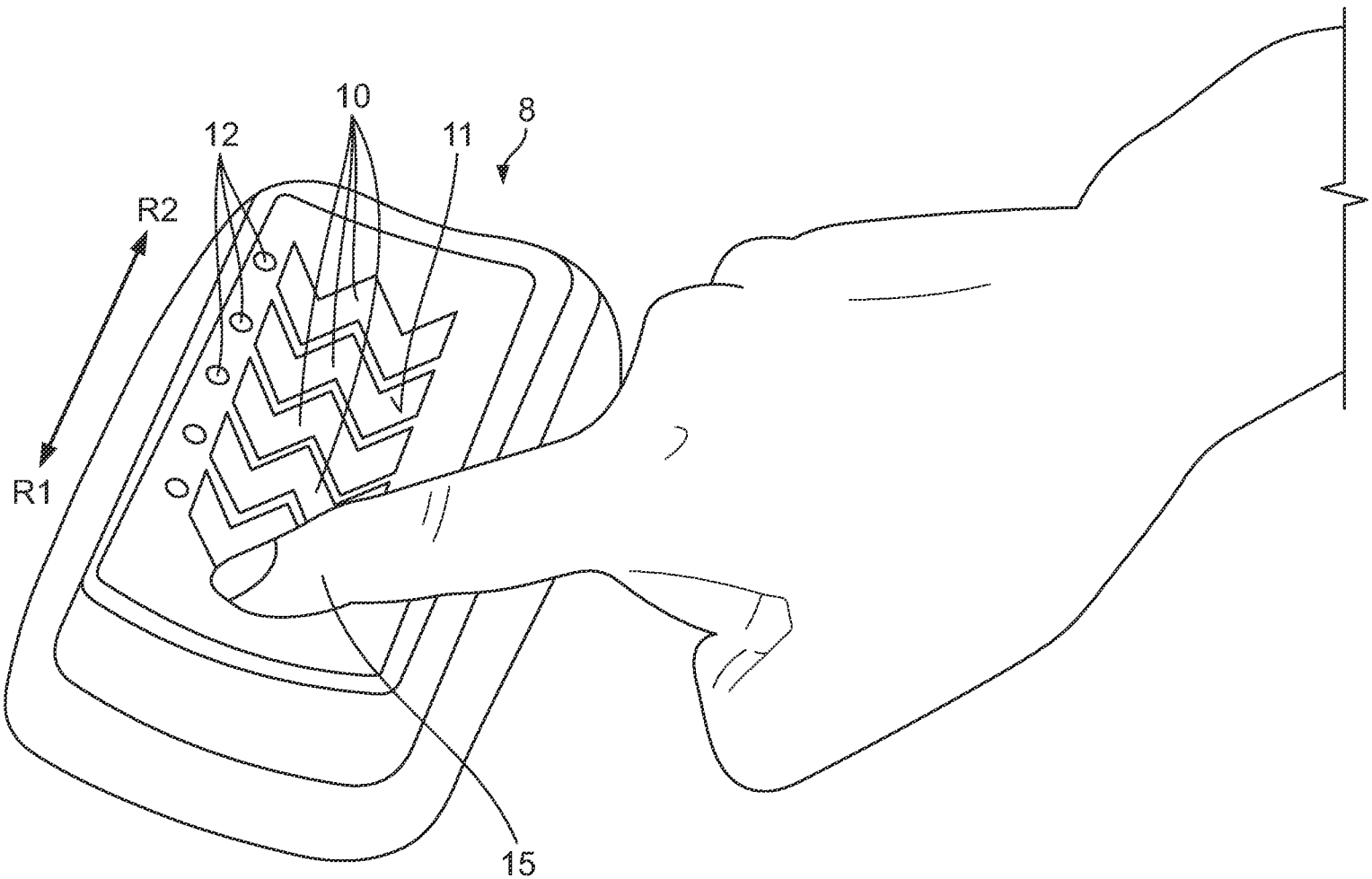

FIG. 1 shows schematically in the side view a sports shoe, depicted partially cut, which can be fastened with a rotary closure and FIG. 2 shows in perspective view a switching element for the actuation of the rotary closure by the finger of the person which uses the sports shoe.

FIG. 1 shows a shoe 1, being a sports shoe, which comprises an upper part 2 and a sole 3. The lacing of shoe 1 is carried out by means of a rotary closure 4 (i. e. a central closure), whereby by turning a tensioning roller 6 at least one tensioning element 5 is wound onto the tensioning roller 6 and so the upper part 2 is tensioned or laced at the foot of the wearer of shoe 1. The tensioning element 5 and its course are only very schematically indicated in FIG. 1.

The rotary closure 4 is located in the sole 3 of shoe 1. A switching element 8 for actuating the rotary closure 4 is arranged on the instep 13 of the shoe 1 at a distance from the rotary closure 4. This provides easy access to the switching element 8 for operating the rotary closure 4.

The electric motor 7 required to operate the rotary closure 4 is indicated; it drives the tensioning roller 6 via a gearing 16. The operation of the electric motor 7 to open and close the rotary closure 4 is initiated by control means 9 which are connected to the switching element 8. A battery 14 is provided for the power supply of electric motor 7 and control means 9.

To close and open shoe 1, the user proceeds as follows:

As shown in FIG. 2, the switching element 8 has a surface 11 which is equipped with a number of touch-sensitive sensors 10. Specifically, five touch-sensitive sensors 10 are arranged linearly next to each other. The individual touch-sensitive sensors 10 are designed as capacitive sensors, which are known as such in the state of the art. They react to contact with the finger 15 of the user of shoe 1.

To close the shoe, the user uses his finger 15 to sweep the touch-sensitive sensors 10 in a first direction R1. If the control means detects said contacting of the sensors 10, it causes a first lacing force level to be reached, i.e. the electric motor 7 is operated with a first, predetermined maximum value for the motor current, e. g. 1.5 A.

Illumination elements 12 in the form of LEDs are arranged on switching element 8. By activating one or more of the illumination elements 12, the user can be informed of the lacing force level.

If the passing of the sensors 10 is repeated with the finger 15 in the first direction R1, a second, higher lacing force level can be approached; a second, preset maximum value for the motor current can now be 2.5 A, for example.

If the sensors 10 are passed again, the lacing force level can be further increased; a third, preset maximum value for the motor current can now be 3.5 A, for example.

The illumination elements 12 can in turn be used to indicate the current lacing force level.

To open the shoe 1, the user sweeps the surface 11, i. e. the touch-sensitive sensors 10, in a second direction R2, opposite to the first direction R1, with his finger 15. The control means 9 then initiate the complete opening of the shoe. The electric motor 7 then moves to the fully relaxed state, which can be determined by a corresponding rotation angle sensor on the tensioning roller 6.

This means that the user does not have to operate a closing or opening switch for a longer period of time—as in the state of the art; it is sufficient to pass over the touch-sensitive sensors 10 in the manner described.

This is an advantage for the user as it allows him to select the appropriate lacing force level for his requirements without having to adjust this by pressing the closing switch for a corresponding length of time.

REFERENCE NUMERALS

1 Shoe
2 Upper part
3 Sole
4 Rotary closure
5 Tensioning element
6 Tensioning roller
7 Electric motor
8 Switching element
9 Control means
10 Touch-sensitive sensor
11 Surface
12 Illumination element (LED)
13 Instep
14 Battery
15 Finger
16 Gearing
R1 First direction
R2 Second direction

The invention claimed is:

1. A method for fastening a shoe, wherein the shoe comprises:

an upper part and a sole which is connected with the upper part;

a rotary closure for fastening the shoe on a wearer's foot using at least one tensioning element, wherein the rotary closure comprises a rotatably arranged tensioning roller for winding the tensioning element, wherein the tensioning roller is driven by an electric motor; and a switching element which is arranged at an instep and which is connected to a controller, wherein the switching element and the controller are configured to actuate the electric motor, wherein an operation of fastening the shoe takes place by actuating of the switching element, wherein the switching element comprises a number of touch-sensitive sensors which are arranged one beside the other and form a surface which is accessible to the wearer, and wherein the method comprises the steps of:

receiving a first swipe over the surface of the touch-sensitive sensors in a first direction, detecting the first swipe signal of the touch-sensitive sensors by the controller, and causing the fastening of the shoe at the foot of the wearer at a first level of fastening force by the controller and the electric motor, wherein the tensioning roller includes a rotation angle sensor, and wherein the rotation angle sensor is configured to detect a zero position of the tensioning roller once the shoe reaches a fully de-laced end position.

2. The method of claim 1 further comprising the steps of:

receiving a second swipe over the surface of the touch-sensitive sensors in the first direction, and detecting the second swipe signal of the touch-sensitive sensors by the controller and causing the fastening of the shoe at the foot of the wearer at a second level of fastening force which is higher than the first level of fastening force by the controller and the electric motor.

3. The method of claim 2 further comprising the steps of:

receiving a third swipe over the surface of the touch-sensitive sensors in the first direction, and detecting the third swipe signal of the touch-sensitive sensors by the controller and causing the fastening of the shoe at the foot of the wearer at a third level of fastening force which is higher than the second level of fastening force by the controller and the electric motor.

4. The method of claim 3 further comprising the steps of:

receiving a fourth swipe over the surface of the touch-sensitive sensors in a second direction which is opposite to the first direction, and detecting the fourth swipe signal of the touch-sensitive sensors by the controller and causing an opening of the shoe or a reduction of the level of the fastening force by the controller and the electric motor.

5. The method of claim 1, wherein a number of illumination elements are arranged along the switching element, and wherein the level of the fastening force is displayed by a plurality of activated illumination elements.

6. The method of claim 1, wherein a number of illumination elements are arranged along the switching element, and wherein an open state of the shoe is indicated by the illumination elements.

7. The method of claim 1, wherein a pressure sensor on or inside the shoe is configured to detect a degree of lacing tension of the shoe on the wearer.

8. The method of claim 7, wherein the pressure sensor provides a pressure reading that is compared with a set value to determine if the pressure is too high, and wherein a pressure that is determined to be too high triggers an automatic reduction of lacing tension.

9. A method for fastening a shoe, wherein the shoe comprises:

an upper part and a sole which is connected with the upper part;

a rotary closure for fastening the shoe on a wearer's foot using at least one tensioning element, wherein the rotary closure comprises a rotatably arranged tensioning roller for winding the tensioning element, wherein the tensioning roller is driven by an electric motor; and a switching element which is arranged at an instep and which is connected to a controller, wherein the switching element and the controller are configured to actuate the electric motor, wherein an operation of fastening the shoe takes place by actuating of the switching element, wherein the switching element comprises a number of touch-sensitive sensors, wherein the method comprises the steps of:

receiving a first swipe over a surface of the touch-sensitive sensors in a first direction, and detecting the first swipe signal of the touch-sensitive sensors by the controller and causing the fastening of the shoe at the foot of the wearer at a first level of fastening force by the controller and the electric motor, wherein passing over the touch-sensitive sensors in the first direction, over only a part of the surface, causes an increase in force proportional to a length of a pass compared to a full length of the switching element, wherein a number of illumination elements, including a plurality of LEDs, are arranged along the switching element, wherein a level of the fastening force is displayed by a first number of activated illumination elements, and wherein passing over the touch-sensitive sensors in the first direction, over only a part of the surface, causes a proportional partial activation of the illumination elements to reflect a change in fastening force.

10. The method of claim 9 further comprising the steps of:

receiving a second swipe over the surface of the touch-sensitive sensors in a second direction which is opposite to the first direction, and detecting the second swipe signal of the touch-sensitive sensors by the controller and causing an opening of the shoe or a reduction of the level of the fastening force by the controller and the electric motor, wherein passing over the touch-sensitive sensors in the second direction, over only a part of the surface, causes a decrease in force proportional to a length of a pass compared to the full length of the switching element.

11. The method of claim 10, wherein passing over the touch-sensitive sensors in the second direction, over only a part of the surface, causes a proportional partial deactivation of the illumination elements to reflect a change in fastening force.

12. A method for fastening a shoe, wherein the shoe comprises:

an upper part and a sole which is connected with the upper part;

a rotary closure for fastening the shoe on a wearer's foot using at least one tensioning element, wherein the rotary closure comprises a rotatably arranged tensioning roller for winding the tensioning element, wherein the tensioning roller is driven by an electric motor; and a switching element which is arranged at an instep and which is connected to a controller, wherein the switching element and the controller are configured to actuate the electric motor, wherein an operation of fastening the shoe takes place by actuating of the switching element by the wearer of the shoe, wherein the switching element comprises a number of touch-sensitive sensors, wherein the method comprises the steps of:

receiving a first swipe over a surface of the touch-sensitive sensors in a first direction, and detecting the first swipe signal by the controller and causing the fastening of the shoe at the foot of the wearer at a first level of fastening force by the controller and the electric motor, and wherein the first level fastening force is defined by a first current level, wherein the first current level is between 1.1 and 3.9 A, wherein the tensioning roller includes a rotation angle sensor, and wherein the rotation angle sensor is configured to detect a zero position of the tensioning roller once the shoe reaches a fully de-laced end position.

13. The method of claim 12 further comprising the steps of:

receiving a second swipe over the surface of the touch-sensitive sensors in the first direction, and detecting the second swipe signal by the controller and causing the fastening of the shoe at the foot of the wearer at a second level of fastening force which is defined by a second current which is different than the first current.

14. The method of claim 13 further comprising the steps of:

receiving a third swipe over the surface of the touch-sensitive sensors in the first direction, and detecting the third swipe signal by the controller and causing the fastening of the shoe at the foot of the wearer at a third level of fastening force which is defined by a third current which is different than the first current and the second current.

15. The method of claim 14 further comprising the steps of:

receiving a fourth swipe over the surface of the touch-sensitive sensors in a second direction which is opposite to the first direction, and detecting the fourth swipe signal of the touch-sensitive sensors by the controller and causing an opening of the shoe which is defined by reverting to a fourth current which is less than the first current level.

16. The method of claim 15 further comprising the steps of:

receiving a fifth swipe over the surface of the touch-sensitive sensors in the second direction, and detecting the fifth swipe signal of the touch-sensitive sensors by the controller and causing a reduction of the level of the fastening force by one incremental current level.

17. The method of claim 14, wherein the first current level is a maximum current level.

18. The method of claim 12, wherein passing over the touch-sensitive sensors in a second direction which is opposite to the first direction, over only a part of the surface, causes a proportional decrease in force, and wherein the decrease in force is defined by a current decrease from the first current level by one incremental current level.

* * * * *